US005140783A

United States Patent [19]

Hoffman

[11] Patent Number: 5,140,783

[45] Date of Patent: Aug. 25, 1992

[54] METHOD FOR SURFACE FINISHING OF ARTICLES

[76] Inventor: Steve E. Hoffman, 6 Maple St., Englewood Cliffs, N.J. 07632

[21] Appl. No.: 759,853

[22] Filed: Sep. 16, 1991

Related U.S. Application Data

[63] Continuation of Ser. No. 543,702, Jun. 26, 1990, abandoned.

[51] Int. Cl.[5] ..... B24B 31/06

[52] U.S. Cl. ..... 51/313; 51/164.5; 51/163.1; 134/7

[58] Field of Search ..... 51/164.5, 316, 321, 51/320, 313, 314, 315; 134/7; 241/84, 184

[56] References Cited

U.S. PATENT DOCUMENTS

| | | | |
|---|---|---|---|
| 1,352,598 | 9/1920 | Hart | 51/316 |
| 1,807,383 | 5/1931 | Carnahan | 241/21 |
| 1,934,494 | 11/1933 | Gillespie | 154/7 |
| 2,062,671 | 12/1936 | Lupo | 51/316 |
| 2,185,262 | 1/1940 | Lupo | 51/316 |
| 2,328,998 | 9/1943 | Radford | 51/404 |
| 2,440,656 | 4/1948 | Huntington | 51/303 |
| 2,624,988 | 1/1953 | Vanderwal | 51/34 |
| 2,947,124 | 8/1960 | Madigan et al. | 51/164.5 |
| 3,426,378 | 2/1969 | Ashworth | 134/7 |
| 3,453,782 | 7/1969 | Hagelüken et al. | 51/164.5 |
| 3,613,317 | 10/1971 | Kittredge et al. | 51/164.5 |

*Primary Examiner*—Robert A. Rose
*Attorney, Agent, or Firm*—Fred A. Keire; Theodore F. Shiells

[57] ABSTRACT

A method for mechanically finishing parts having the step of agitating a plurality of parts to be finished in contact with a plurality of discrete substantially homogeneous compressed felt chunks having a particulate abrasive material coating thereon.

22 Claims, 2 Drawing Sheets

FIG. 2
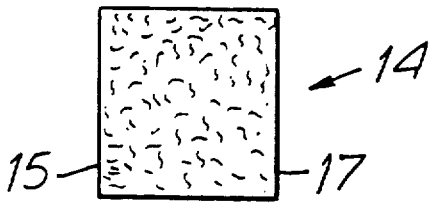
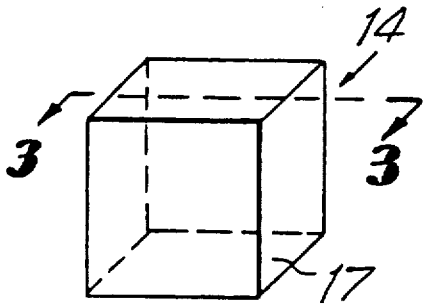
FIG. 3
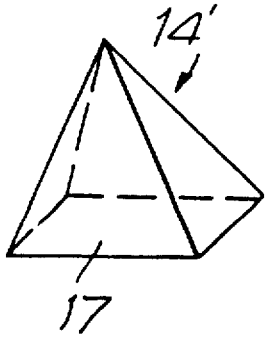
FIG. 4
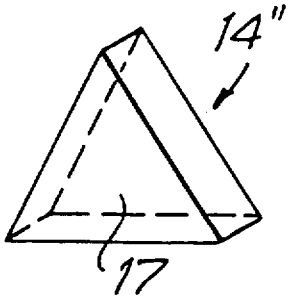
FIG. 5

METHOD FOR SURFACE FINISHING OF ARTICLES

This application is a continuation, of application Ser. No. 543,702, filed Jun. 26, 1990 now abandoned.

FIELD OF THE INVENTION

The present invention relates generally to the art of vibratory and tumbling deburring or surface finishing.

BACKGROUND OF THE INVENTION

It is known that tumbling or vibrating parts to be surface finished (i.e. metals, plastics, etc.) in tubs containing numerous abrasive media "rocks" results in a smooth surface finish for the parts. The number of "rocks" used varies with the size of the tub and the number of parts to be finished, but may generally range from approximately 100 to 10,000 or more. The rotational or vibratory forces cause the abrasive media "rocks" and parts to interact and in effect deburr excess material from the parts and smooth rough spots on the parts. Water or other liquid compatible with the parts to be finished and the abrasive coated media rocks is usually added to the machine's tub to facilitate the process. The water or other liquid is continually or periodically drained during the machine's operation carrying with it waste from the media and the finished part.

Typically, media rocks used for this purpose have been made of hard and solid material such as natural stone, abrasive ceramic or metal. Although hard media is effective for some purposes, hard media is disadvantageous in that such media cannot conform to the shape of the parts to be finished, and hard media has difficulty imparting a fine, highly polished surface.

Some efforts have been made to employ flexible media, but such efforts have not be entirely successful. In U.S. Pat. No. 3,613,317, it is proposed to use abrasive impregnated resilient polymeric media whose hardness varies with the change in agitation temperature. This polymeric media is said to accommodate operations that require both high and low cut rate agitation by changing the water temperature added to the media. Thus, an extra step of obtaining high temperatures is needed in the agitation operation for the media to reach the soft state. Moreover, the temperature of a finishing operation is difficult to control in practice, and thus control of the desired finish is equally difficult. In addition, it has been found that this type of polymeric media can result in formation of a toxic sludge, which complicates disposal.

In U.S. Pat. No. 3,453,782, it is proposed to use media having a core of high specific weight material, such as a steel ball, surrounded by a resilient shell of a porous material, such as felt or foam rubber, the pores of which are filled with an abrasive material. It is said that the solid, high density core serves to provide the necessary weight for the media stones to effectively agitate with the parts and, in particular, to act as a solid bumper against which parts can bounce off upon contact, creating a "pumping" action which causes the particles imbedded in the shell's pores to rise to the surface. The core, however, acts as a detriment by limiting the size and shape of the media. Such media is also relatively heavy owing to the presence of the high density core, presenting storage and transportation difficulties. Furthermore, the fabrication of such media is relatively expensive, because each media "rock" consists of a solid core and two shell halves affixed together—essentially three parts for each "rock".

OBJECTS OF THE INVENTION

Accordingly, it is an object of the present invention to provide a method for finishing parts in vibratory and tumbling machinery which avoids the foregoing disadvantages.

In particular, it is an object of the present invention to provide a method for vibratory or tumbling surface finishing of parts which is inexpensive and effective to impart a highly polished surface, even to irregular surfaces.

It is a further object of the invention to provide a method for vibratory or tumbling surface finishing of parts which uses media which is relatively lightweight when dry and easy to store and transport.

SUMMARY OF THE INVENTION

In accordance with a preferred embodiment of the present invention, a method for mechanically finishing parts is provided comprising the step of agitating a plurality of parts to be finished in contact with a plurality of discrete substantially homogeneous compressed felt chunks having a particulate abrasive material coating thereon.

In accordance with another aspect of this preferred embodiment, the method of the present invention comprises the additional step of adding liquid to said chunks to substantially increase their weight prior to agitation. In a preferred aspect of this embodiment, sufficient liquid is added to substantially saturate the felt.

In accordance with another aspect of the preferred embodiment of the present invention, the method employs compressed felt having a dry density in the range of about 20 to 45 lbs per cubic foot.

BRIEF DESCRIPTION OF THE DRAWINGS

These, and other objects, features and advantages of the present invention will be apparent to those skilled in the art with reference to the following detailed description and drawings of the present invention, wherein:

FIG. 2 is a cross-sectional view of a compressed felt chunk particularly adapted for use in the method of the present invention having an exemplary cubic shape, taken along the line 3—3 of FIG. 3;

FIG. 3 is perspective view of a compressed felt chunk particularly adapted for use in the method of the present invention having an exemplary cubic shape; and FIG. 4 is a perspective view of a compressed felt chunk particularly adapted for use in the method of the present invention having an exemplary pyramidal shape; and FIG. 5 is a perspective view of a compressed felt chunk particularly adapted for use in the method of the present invention having an exemplary triangular shape.

DETAILED DESCRIPTION OF THE PREFERRED EMBODIMENT

Figure 1:
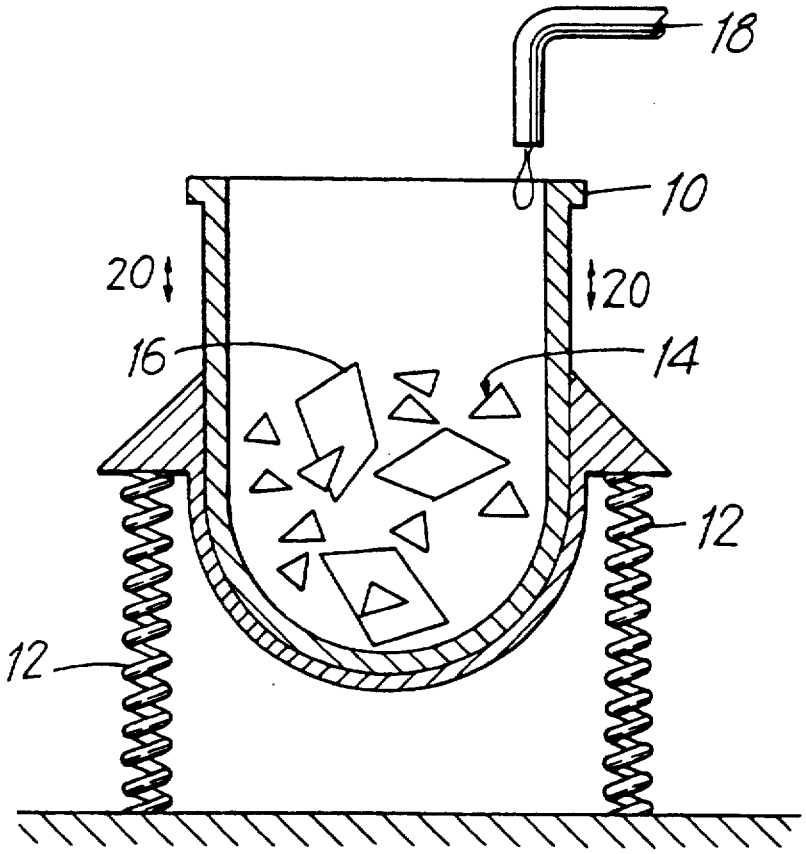
FIG. 1 is a diagrammatic cross-sectional view illustrating the method of a preferred embodiment of the present invention.

Turning now to the drawings in detail and initially to FIG. 1 thereof, a preferred manner of practicing the invention is shown. Tub 10 or similar receptacle is fixed for vibration on mounting means 12. In lieu of a vibratory tub, a tumbling barrel or other such agitation device may be employed to like effect. A plurality of media rocks 14 comprising abrasive coated, substantially uniform density compressed felt and parts 16 to be finished are both placed into tub 10.

The compressed felt media rocks 14 of the present invention will become saturated when placed in sufficient water or other liquid. However, the compressed felt rocks 14 are much lighter and easier to store and handle when in the dry condition. Accordingly, preferably media rocks 14 are placed into tub 10 while the media rocks 14 are dry. However, if desired, the media rocks can be wetted prior to loading into the tub 10.

The quantity of rocks loaded into the tub range from 100 to 10,000 rocks. A liquid for facilitating the finishing process can be placed into tub 10 through faucet 18. The most commonly used liquid is water although other liquids, such as kerosene, light cutting oils or vegetable oils, may be employed depending upon the finishing to be performed, providing the liquid is compatible with the felt of the media rocks 14 and the parts 16. The compressed felt media rooks 14 absorb this water or other liquid to substantially increase in weight prior to agitation. Preferably, sufficient liquid is added to substantially saturated the felt. The step of liquid addition to the tub can be performed with equal efficacy before or after the parts 16 and media rocks 14 are loaded into the tub. However, if the media rocks 14 placed into the tub 10 were already saturated when loaded, the amount of water or other liquid must be adjusted accordingly. Sufficient liquid can be added so that there is free liquid (i.e. unabsorbed by the felt rocks), although this is not necessary for the invention. In fact, it is preferred in the present invention that there be little or no free liquid during agitation, and the ability of the method of the present invention to effectively finish articles without free liquid is a particular advantage. In applications where free liquid is required depending upon the type of finishing to be performed, the amount of free liquid is well-known to those skilled in the art.

In FIG. 2 the homogeneous felt abrasive media rock 14 is shown. The media rock 14 preferably consists of substantially homogeneous and uniform density compressed fiber felt 13, preferably wool, cut into about 1" chunks of any shape. Preferably, the felt rock 14 has a cubic shape, such as shown in FIG. 3, because it is easier to fabricate. However, pyramid shaped rocks 14' as shown FIG. 4, and triangle shaped rocks 14" as shown in FIG. 5 and virtually any other shapes and sizes appropriate to the particular finishing operation may be employed.

Preferably, the fibrous material of the felt retains relatively constant ductility within the range of temperatures commonly employed in agitation finishers—that is between about 50° and 120 degrees Fahrenheit. Wool accomplishes this purpose. Polyester, or other material compatible with the finishing liquid to be used, may also be employed, however polymeric materials will tend to have less constant ductility with temperature than natural materials such as wool. In any event, because a homogeneous porous felt material is preferably used, rather than a substantially solid material, changes in the resilience or ductility of the fibrous material itself with temperature will not greatly change the overall softness of the felt rock 14 when saturated with liquid.

The compressed felt preferably has a density of from about 20 to 45 lbs. per cubic foot in the dry condition. It has been found that dry densities in the range of about 26 lbs. per cubic foot are particularly advantageous for most applications. However, other densities can be used depending upon the material to be finished. When saturated with liquid, the felt rocks are of greater density. Since quantities of 100 to 10,000 media stones are typically used in agitation operations, the initial loading of the media into the tub is facilitated by the use of these lightweight media rocks in their unsaturated condition.

The felt is preferably initially treated with a light coating of oil 15 to seal loose fibers and to help abrasive coating 17 to adhere to the felt. This light coating is not, however, intended to saturate the felt. The abrasive used to coat the felt rocks 14 may be any particulate abrasive commonly employed in finishing operations, such as aluminum oxide, zirconium carbide, zirconium oxide, ground pumice, emery and the like. Abrasive coating 17 is applied to coat all exterior surfaces of the felt rock. In lieu of applying a light coating of oil to held adhere the abrasive, the abrasive can also be applied as a paste, or in other convenient manner. Because the felt is porous, the abrasive coating 17 will be entrained to some degree into the surface of the felt, thus assisting an maintaining adherence of the abrasive coating 17 to the felt.

Once fully loaded with parts 16, rocks 14 and water or other liquid (if added), the tub 10 is subjected to agitation, in this exemplary embodiment gyratory vibration, causing a movement of the contents of tub 10 in the direction shown by the arrows. In a tumbler barrel, of course, the barrel would be rotated to cause the appropriate agitation. The constant agitation causes repeated random surface contact between parts 16 and the media rocks, deburring excess material from the parts and finishing the surfaces of the parts. As the felt rocks 14 are pressed between parts 16 during the agitation, the saturated felt "squishes" to some degree like a wet sponge, absorbing shocks and conforming to the irregularities of the surfaces of the parts. In addition, the felt rocks are preferably quite resilient, and thus tend to return to their original shape and size when a compressive weight is removed. The compression and uncompression of the felt of a "rock" causes linear relative movement of portions of the surface of the "rock" in contact with the surface of an article to be finished, even in the absense of gross relative movement of the entire "rock with respect to the article. This effect further enhances the finishing capabilities of the method of the present invention.

Media rocks 14 are relatively soft compared to conventional hard media owing to the use of compressed felt and conform easily to irregular surfaces of the parts to be finished. Because felt rocks 14 are preferably substantially homogeneous and of substantially uniform density throughout, there is no hard core to impart non-uniformity to the density or to detract from the felt rocks, ability to "squish" and deform in response to irregularities. The density of rocks 14 in use corresponds substantially to that of the felt as saturated by the liquid used in the finishing operation. The density of the felt in the substantially saturated condition has been found to be highly effective for finishing operations requiring a high polish, as well as many other finishing operations.

Because the felt "rocks" employed in the present method are homogeneous, shapes such as rods, cones, and triangles can be readily used. In addition, small sizes of rocks can be used without any inner core material restriction. Since parts to be finished often require specific shapes for optimum finishing, the homogeneous felt's flexibility is important to accommodate these needs.

Because the material of the felt rocks 14 employed in the method of the present invention is preferably non-toxic, discharge from the finishing operation is substantially non-toxic, decreasing environmental hazards upon discharge.

Although an exemplary embodiment of the present invention has been described herein, it is to be understood that various modifications of the present invention will be apparent to those skilled in the art, and there is no intention of excluding such modifications from the scope of the present invention. Rather, the scope of the invention is to be defined by the appended claims.

What is claimed is:

1. A method for mechanically finishing parts comprising the step of:

agitating a plurality of parts to be finished in contact with predominantly a plurality of discrete, homogeneous compressed felt chunks, said chunks being elastically compressible to a significant degree and having a particulate abrasive material coating thereon.

2. The method according to claim 1 comprising the additional step of first adding liquid to said chunks.

3. The method according to claim 2 wherein the amount of liquid is sufficient to substantially increase their weight prior to agitation.

4. The method according to claim 1 wherein said felt is composed of fibers having a relatively constant ductility with varying temperatures.

5. A method according to claim 1 wherein said compressed felt has a dry density in the range of about from 20 to 45 lbs. per cubic foot.

6. The method according to claim 4 wherein said felt is substantially composed of wool fibers.

7. The method according to claim 4 wherein said felt is substantially composed of polyester fibers.

8. The method according to claim 2 wherein the agitation is accomplished without substantial free liquid.

9. The method according to claim 1 wherein said agitation causes surface finishing primarily by vibratorily inducing relative movement of portions of the surface of said chunks against the surface of the parts as the chunks are repeatedly compressed and expanded by induced vibrations while in contact with the surface of at least one of said parts.

10. The method according to claim 1, wherein said felt has a dry density of approximately 26 pounds per cubic foot.

11. A part having a finished surface, said surface being finished substantially by relative movement of portions of the surface of abrasive coated, discrete, homogeneous compressed felt chunks which are elastically compressible to a significant degree, said relative movement being caused by repeated compression and expansion of said chunks by induced vibrations while said chunks are in contact with the surface of said part.

12. The method according to claim 1, wherein said agitation is vibratory agitation.

13. The method according to claim 1, wherein said chunks have at least one dimension in the range of one inch.

14. The method according to claim 1, wherein said chunks have a dry density in the uncoated state of at least 20 pounds per cubic foot.

15. The method according to claim 14, wherein said chunks have a dry density in the uncoated state in the range of about 20–45 pounds per cubic foot.

16. Media for mechanically finishing parts in an agitating drum, said media consisting substantially of a plurality of discrete, homogeneous compressed felt chunks which are elastically compressible to a significant degree and have a particulate abrasive material coating thereon.

17. The media according to claim 16, wherein said chunks have at least one dimension in the range of one inch.

18. The method according to claim 16, wherein said chunks have a dry density in the uncoated state of at least 20 pounds per cubic foot.

19. The media according to claim 18, wherein said chunks have a dry density in the uncoated state in the range of about 20–45 pounds per cubic foot.

20. The media according to claim 19, wherein said chunks have a dry density in the uncoated state of about 26 pounds per cubic foot.

21. The media according to claim 16 wherein said felt is substantially composed of wool fibers.

22. The media according to claim 16 wherein said felt is substantially composed of polyester fibers.

* * * * *